United States Patent [19]

Neuberger et al.

[11] 4,153,459

[45] May 8, 1979

[54] HYBRID COLOR PHOTOGRAPHIC ELEMENTS AND PROCESSES FOR DEVELOPING SAME

[75] Inventors: Dan Neuberger; Jon T. Staples, both of Rochester, N.Y.

[73] Assignee: Eastman Kodak Company, Rochester, N.Y.

[21] Appl. No.: 636,395

[22] Filed: Dec. 1, 1975

Related U.S. Application Data

[63] Continuation of Ser. No. 416,706, Nov. 16, 1973, abandoned.

[51] Int. Cl.[2] ..... G03C 3/00; G03C 1/76; G03C 1/84; G03C 7/04

[52] U.S. Cl. ..... 96/73; 96/74; 96/9; 96/84 UV

[58] Field of Search ..... 96/74, 73, 120, 73, 96/84 R, 9, 84 UV

[56] References Cited

U.S. PATENT DOCUMENTS

| | | | |
|---|---|---|---|
| 2,219,306 | 10/1940 | Gaspar | 96/84 R |
| 2,431,996 | 12/1947 | Duerr et al. | 96/9 |
| 2,464,798 | 3/1949 | Duerr et al. | 96/9 |
| 3,362,820 | 1/1968 | Hellmig | 96/9 |
| 3,415,644 | 12/1968 | Land | 96/29 D |
| 3,497,350 | 2/1970 | Yutzy et al. | 96/9 |

FOREIGN PATENT DOCUMENTS

| | | | |
|---|---|---|---|
| 807045 | 12/1936 | France | 96/74 |
| 811606 | 4/1937 | France | 96/74 |
| 872604 | 6/1942 | France | 96/74 |

*Primary Examiner*—J. Travis Brown
*Assistant Examiner*—L. Falasco
*Attorney, Agent, or Firm*—Joshua G. Levitt

[57] ABSTRACT

Color photographic elements containing silver halide and incorporated colored and color-forming materials are described. These elements have (a) a layer containing a yellow dye or yellow dye precursor that is bleachable by a mild silver-dye-bleach procedure and (b) at least one other layer, spectrally sensitized to green light, which contains a color-forming coupler which forms magenta dye upon reaction with oxidized color developer. Such elements, when they are processed by a process have improved graininess and yield sharper images. The novel process comprises the steps:

a. develop in black and white developer,
b. apply non-fixing silver-dye-bleach solution,
c. rinse,
d. fog and color develop
e. wash
f. bleach and fix.

A "positive" colored image results.

12 Claims, 5 Drawing Figures

Figures 1A, 1B, 1C:
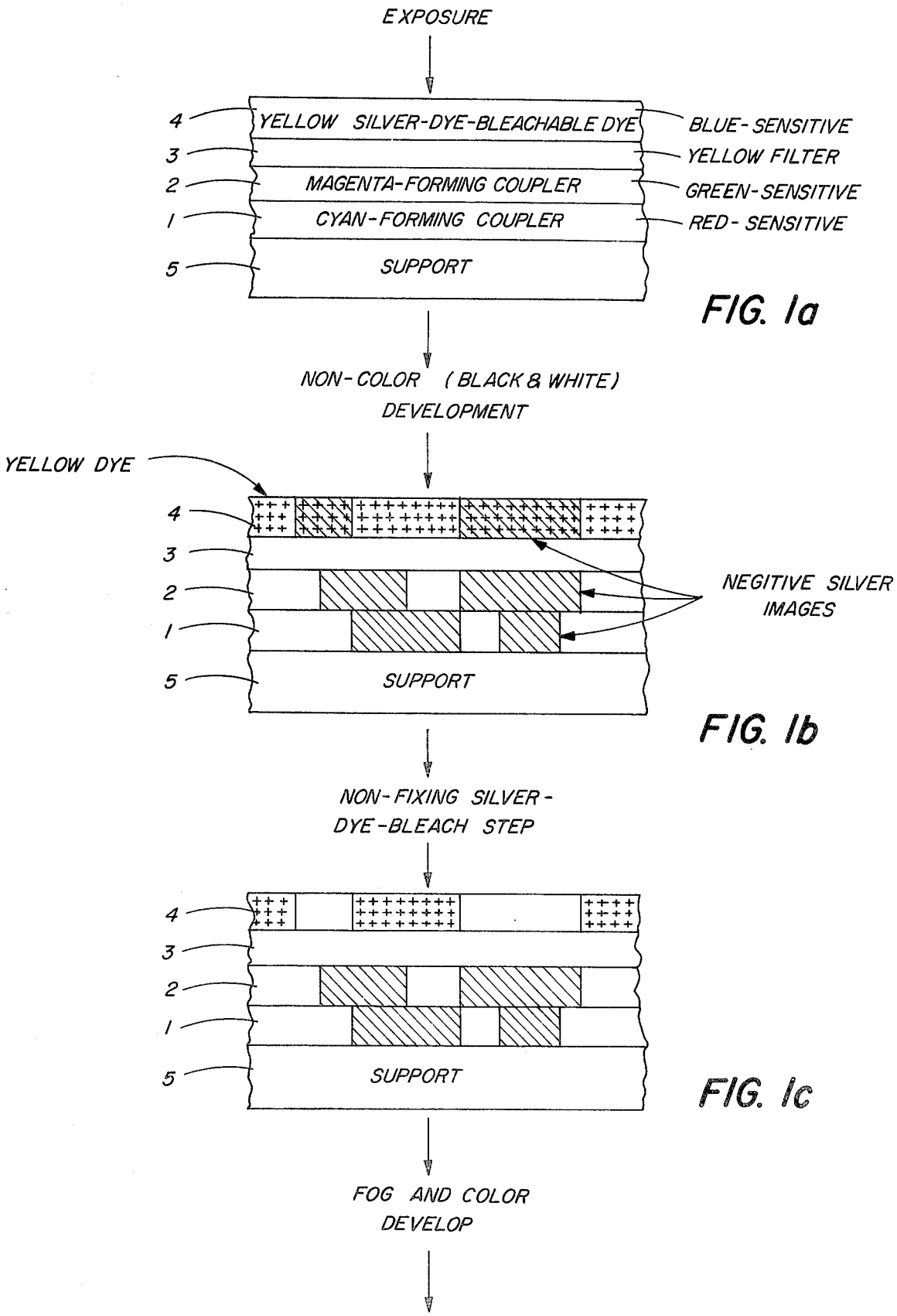

EXPOSURE
4
YELLOW SILVER-DYE-BLEACHABLE DYE
BLUE-SENSITIVE
3
YELLOW FILTER
2
MAGENTA-FORMING COUPLER
GREEN-SENSITIVE
1
CYAN-FORMING COUPLER
RED-SENSITIVE
5
SUPPORT

NON-COLOR (BLACK & WHITE) DEVELOPMENT
YELLOW DYE
NEGITIVE SILVER IMAGES

NON-FIXING SILVER-DYE-BLEACH STEP

FOG AND COLOR DEVELOP

HYBRID COLOR PHOTOGRAPHIC ELEMENTS AND PROCESSES FOR DEVELOPING SAME

This application is a continuation of United States Patent Application Ser. No. 416,706, filed Nov. 16, 1973, now abandoned.

This invention relates to color photography, to novel photographic film and paper elements, and to novel processes for developing such elements. More particularly, this invention relates to a vaulable combination of (a) silver-dye-bleach techniques and materials therefor with (b) techniques and materials relating to the use of incorporated color-forming couplers, to obtain photographic end products which are better in certain respects than those obtained heretofore using either (a) or (b) alone.

BACKGROUND AND PROBLEMS

The use of color-forming coupler compounds which react with the development product of primary aromatic amino developing agents to form colored images upon photographic development is well known and has been the subject of many patents and other publications. The dyes formed in this way are usually insoluble in water and in the ordinary development and fixing solutions. Such coupler compounds may conventionally be added to the development solutions, or they may be incorporated into the photographic layers during the manufacture of the light sensitive elements. In this latter instance, the coupler compounds are referred to as "incorporated couplers". Incorporated couplers usually remain essentially immobile in their respective layer of the photographic element due largely to the fact that their molecules are fairly large. Immobile incorporated color-forming coupler compounds usually contain at least one so-called "ballasting" group in their molecule. Such "ballasted" photographic couplers are well known in the art and need not be dealt with in detail at this point. It should be understood that the incorporated couplers referred to herein are of the ballasted type.

Color-forming coupler compounds are generally used for subtractive color photography. Upon color development they form yellow, magenta or cyan dyes. For several important and well-known reasons, subtractive color photographic elements contain at least three distinct layers coated on a photographic support such as a transparent polymeric sheet. Generally, cyan-forming materials are placed in the color layer nearest the support, the silver halide in that layer being spectrally sensitized to the red region of the visible spectrum. In a color layer over the red-sensitized layer just described (possibly separated from that layer by one or more additional special purpose layers) is usually placed a magenta-forming layer, into which is incorporated magenta-forming color couplers. The silver halide in this magenta-forming layer is spectrally sensitized to the green region of the visible spectrum. In a third color-forming layer, which is coated over the green-sensitized layer (usually with a blue-light-absorbing layer between them) are incorporated yellow-forming coupler compounds. This yellow layer contains silver halide that is sensitive essentially to only the blue region of the visible spectrum.

Over the years, color photographic technology has been advanced and refined to the point that significant improvements are difficult to obtain. Meanwhile, consumers of film and paper based photographic products continue to demand products having better properties. Typical of the properties of concern to consumers are those directed to the sharpness and granularity of the final photographic product; i.e., the color photograph.

It is generally known that in order to improve the granularity of the image without decreasing the speed of the element a larger number of silver halide grains should be used. Granularity can also be improved by reducing the size of the silver halide grains, but this results in undesired loss of the photographic speed or sensitivity of the element. Thus, by increasing the number of silver halide grains (to improve granularity), one must increase the relative amount of silver halide in each layer. Since increases in the silver halide content of a layer generally caused concomitant increases in dye density (in each of the color layers) photographic products could result from using this approach (more silver halide) which have color densities that are too high. This, of course, would also be undesirable.

One method of overcoming the problems caused by too much color density is to use a so-called "competing coupler" during the development of the element. The competing coupler preferably forms either a colorless compound upon its reaction with oxidized color developer, or a dye which is soluble in the developer solution and can be removed by rinsing the developed element. The type and amount of competing coupler would be chosen so that the undesirable increase in color density referred to above would not occur.

A complication in our problem must be considered at this point. That is, while improving the granularity in the magenta and cyan layers by increasing the amount of silver halide in these layers, and by using higher levels of competing couplers (to compensate for excessive dye formation due to the additional developed silver halide), one must also increase the amount of silver halide in the top (yellow) color-forming layer. That is, however, undesirable, because the silver halide grains in the yellow color-forming layer scatter the green and red light that passes through the "yellow" dye layer to such an extent that the desired degree of sharpness in the magenta and cyan layers could not be obtained. However, by using only relatively low levels of silver halide in the yellow dye layer, the use of relatively higher concentrations of competing couplers (as described above) would be expected to cause an unacceptable loss of yellow color from the yellow dye layer.

It is an object of the present invention to overcome the apparent dilemma described above, so that one can obtain subtractive color photographic products which (i) exhibit the improved granularity characteristics described above (ii) have magenta and cyan dye levels which are not too high, and (iii) have yellow dye levels which are not too low. Thus, the resulting photographic color products also exhibit excellent color fidelity.

SUMMARY OF THE INVENTION

This object, and other objects which will be apparent to the reader hereof, can be attained, surprisingly, by combining carefully selected parts of two different types of color photographic technologies in a special way. The resulting novel photographic elements, which will be hereinafter termed "hybrid-BDIC" elements (BDIC stands for "Bleachable Dye/Incorporated Coupler"), are an important aspect of the present invention. Another important aspect of this invention relates to the novel processes that have been invented in order to convert these hybrid-BDIC elements to the desired finished photographic color products. The aforementioned two different color photographic technologies are the well known "silver-dye-bleach" technology and the well-known "incorporated coupler" technology.

1. The Photographic Elements of the Invention

The hybrid-BDIC color photographic elements of the present invention are multi-layered materials comprising a photographic support, and coated on said support, at least two (layers a and b described below), and preferably at least three photosensitive silver halide-containing photographic emulsion layers, identified as follows:

(a) a first emulsion coating which is sensitive to the blue region of the visible spectrum, which first coating contains a yellow dye or yellow dye precursor which is capable of being destroyed as a quantitative function of the metallic silver content of said first layer when the element is contacted with a silver-dye-bleach solution;

(b) a second emulsion coating which is spectrally sensitized to the green portion of the visible spectrum, and which second coating contains at least one color-forming coupler material capable of forming a magenta dye upon reaction of said coupler material with oxidized organic amino color developer; and (c) a third emulsion coating which is spectrally sensitized to the red portion of the visible spectrum, and which third coating contains at least one color-forming coupler material capable of forming a cyan dye upon reaction with oxidized oragnic amino color developer.

Note that layer "a", above, incorporates some of the silver-dye-bleach technology while layers "b" and "c" are directed to "color coupler" technology, even though layer "a", if desired, can also contain coupler materials capable of forming a yellow dye upon reaction with oxidized organic amino color developer.

2. The processes of the Invention

The present process, in which the hybrid photographic elements of the present invention can advantageously be used, comprises the following steps, in the order set out:

Step (a) developing an imagewise exposed hybrid BDIC color photographic element with a non-color, so-called "black and white" developer to thereby produce particles of metallic silver only in the light struck areas of said hybrid element;

Step (b) contacting the particles of metallic silver with a silver-dye-bleach solution to thereby destroy an amount of yellow bleachable dye in the blue-sensitive layer of the element; the contacting being made with a non-fixing silver dye-bleach solution;

Step (c) rinsing the resulting silver-dye-bleached element to remove practically all of the silver-dye-bleach solution therefrom (this step not essential);

Step (d) contacting the silver-dye-bleached element with a color developing solution containing a competing colorless coupler and optionally containing a chemical foggant to thereby develop the remaining silver halide particles in the element, which particles had not been exposed prior to Step a of this process, but which are developable in this Step d; whereby the color-forming coupler materials in the element react with the resulting oxidized color developer to form the appropriate dye in the magenta and cyan layers; and Step (e) subsequently bleaching and fixing the resulting color-developed element.

By this process, colored photographic articles can be obtained which are "positives"; i.e., in positive color responsive relationship to the image to which the element was originally exposed, prior to step a of the process. In addition, the objects of the present invention set out above can be obtained via this process.

The reference in Step d, above, to the optional presence in the color developing solution of a chemical foggant relates to the fact that the silver halide in the element which remains undeveloped after Step a of the process must be made developable in, or prior to, Step "d" by some means. One of these means is by chemically fogging the silver halide grains either prior to, or during, the color developing Step d. Another means is by light flashing the element prior to, or during the early stages of the color developing Step d.

THE PRIOR ART

Many of the individual parts of the present invention have been proposed and used heretofore for the solution of problems which differ from those described above. For example, technology relating to the use of incorporated color-forming couplers in subtractive color film elements is used very extensively today, as exemplified in Section XXII of the Product Licensing Index, December, 1971, page 7. Similarly, generic technology relating to the silver-dye-bleach method for obtaining color images has been known for many years, as exemplified at pages 308 and 309 of "The Reproduction of Color In Photography, Printing, and Television", Second Edition, by R. W. G. Hunt; John Wiley & Sons (1967) and in U.S. Pat. No. 2,635,874. Reversal processes which relate to the treatment of those layers of the present elements which contain incorporated color-forming coupler are described in detail in columns 11 and 12 of U.S. Pat. No. 2,944,900; columns 3 through 7 of U.S. Pat. No. 2,984,567; and columns 9 and 10 of U.S. Pat. No. 3,189,452. Competing colorless couplers and some of their uses are described at column 3 through 5 and column 8 of U.S. Pat. No. 3,647,452.

DETAILS CONCERNING THE INVENTION

The present invention is unique in that it involves a combination of selected elements from each of the major technological classes involving (a) color-forming couplers and color development using oxidized organic amino color developers (including the use of colorless competing couplers), and (b) silver-dye-bleach processes and products for the attainment of photographic products having exceptionally low graininess and high color fidelity.

Another unique aspect of the present processes involves the use of a "non-fixing" silver-dye-bleach solution. The term "non-fixing silver-dye-bleach solution", as used herein means a silver-dye-bleach solution which contains the materials necessary for silver-dye-bleaching:

(a) a silver-complexing agent, (b) an acidifying agent, and (c) a dye bleach catalyst such as phenazine.

(but which solution does not substantially fix the undeveloped silver halide in the treated element during the silver-dye-bleach step (i.e., step "b" in the above-described procedure).

One way of accomplishing this essential "non-fixing" is by use of a silver-dye-bleach solution which consists essentially of an acid, a bromide salt, and a dye bleach catalyst dissolved in water, the resulting solution having a pH of from less than 1 to about 3 (preferably about 1). Other materials (such as surfactants and buffering agents) can be present in these non-fixing silver-dye-bleach solutions, so long as they do not interfere with the desired silver-dye-bleach reaction or cause an undesired amount of "fixing" during the silver-dye-bleach step of the present processes. Silver-dye-bleach processes and some azo dyes useful for such processes are described at pages 394 and 395 of Mees' book, "The Theory of the Photographic Process", Third Edition, MacMillan Company (1966).

Details of the present processes can perhaps be more easily understood by reference to the FIGS. 1*a* through 1*e* in conjunction with the following description:

In FIG. 1*a* there is illustrated a preferred photographic element of this invention as manufactured and ready to be imagewise exposed to light. Coated on support layer 5 are (a) layer 1, a red-sensitized silver halide emulsion with incorporated cyan-forming color coupler, (b) layer 2, a green-sensitized silver halide emulsion with incorporated magenta-forming color coupler, (c) layer 3, a filter layer designed to absorb blue light which penetrates layer 4, which is a blue-sensitive silver halide emulsion containing yellow silver-dye-bleachable dye.

FIG. 1*b* represents the element after imagewise exposure and after the non-color ("black and white") development step. Note that negative silver images have been formed in those areas of the element which were light struck prior to the non-color development step.

FIG. 1*c* represents the element subsequent to the non-fixing silver-dye-bleach step of the present processes.

Figure 1D:
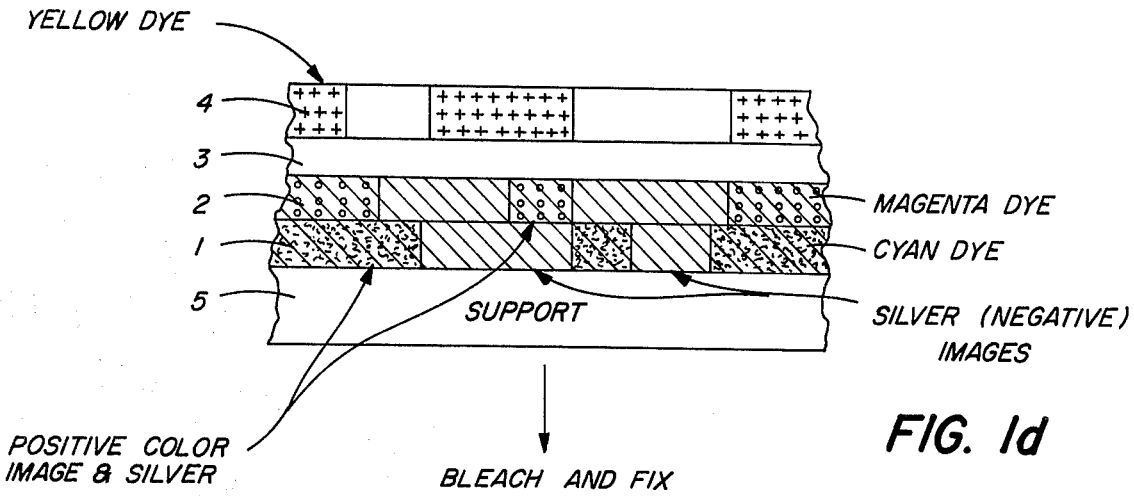

Between FIG. 1*c* and FIG. 1*d*, the element is fogged and color developed, to thereby develop up positive color images in those layers which contain incorporated color-forming coupler(s).

Figure 1E:
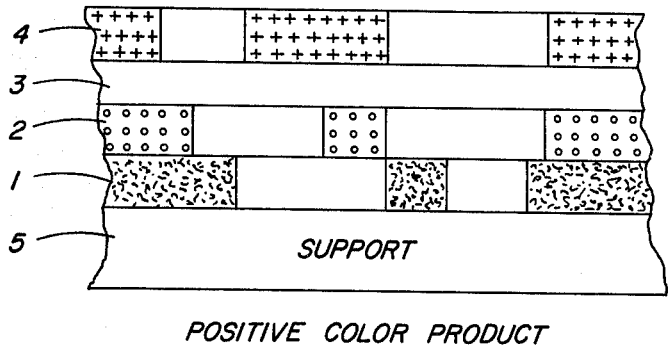

FIG. 1*e* illustrate the final "positive" photographic product which results from the present processes. To achieve this final stage, the element of FIG. 1*d* is subjected to a bleaching and fixing operation, generally followed by a thorough water rinse, if desired.

In FIGS. 1*a* through 1*e*, the multi-layered element comprises a photographic support 5 which has been overcoated with at least four layers. The coating or layer nearest the support 5 is red sensitive layer 1, which (prior to imagewise exposure) comprises a light-sensitive photographic emulsion which has been sensitized so that the light-sensitive component in the emulsion is sensitive to red light. Over red sensitive layer 1 is green sensitive layer 2 and blue sensitive layer 4, each of which is a light sensitive photographic emulsion containing light-sensitive components which are sensitive to blue and green, and blue, light respectively. Yellow filter layer 3 contains one or more materials that absorb any blue light that passes entirely through the blue sensitive layer 4 without interfering substantially with the transmittance of green and red light. One such blue absorbing materials is the well-known Carey Lea filter (very finely divided silver) material. Each of these layers can also contain other photographic emulsion addenda, including anti-foggants, stabilizers, development modifiers, anti-stain, ingredients and the like.

The light-sensitive photographic elements of this invention must contain a substantial amount of yellow bleachable dye in order to achieve the benefit described above. Preferably, at least about half of the yellow portion of the image that is formed in such elements should be one or more bleachable dyes. In a still further preferred embodiment of the present invention, substantially all of the yellow dye is silver-dye-bleachable.

Any silver-dye-bleachable yellow dye can be used successfully (in association with our blue light-sensitive layers) in the practice of the present invention. Yellow bleachable dyes are well known in the art and need not be described in great detail herein, except that silver-dye-bleachable yellow dyes having at least one azo group in their molecules are preferred because of their generally excellent stability to ambient light and to relatively high temperature. Typical examples of such yellow azo dyes which are silver-dye-bleachable include those described in U.S. Pat. Nos. 3,650,739; 3,296,843; and 2,629,658. Still further preferred for use in the present invention are bleachable yellow dyes which are said to be "shifted" or "shiftable". The term "shifted" yellow bleachable dye is intended herein to mean a yellow silver-dye-bleachable dye which has an absorption maximum primarily in the ultraviolet region of the spectrum at ordinary emulsion pH conditions (i.e., pH about 6), but which absorption maximum shifts into the blue region of the spectrum when the element containing the dye is subjected to higher pH solutions (i.e., where the pH is 10 or more). The benefits that can result from using such shifted yellow dyes include better transmittance (penetration) of blue light into the yellow layer of the element, and thus, better speed in the blue portion of the recorded image. (Any blue light that is absorbed directly by the yellow dye in the element is "lost" from the recorded image, since the recordation of the image depends upon absorption of light by the silver halide and/or any sensitizing dyes in the recording layer.) Examples of "shifted" yellow silver-dye-bleachable dyes include (but are not limited to) compounds having the following structures:

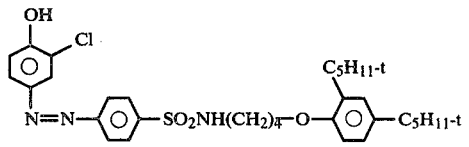

Shifted Dye I and

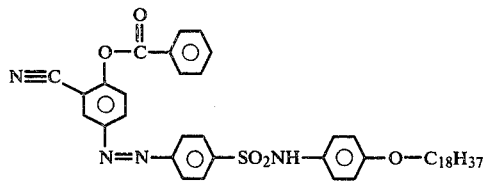

Shifted Dye II

If desired, the yellow bleachable dye(s) that are useful in layers generally overlying the green- and red-sensitive layers of the present photographic elements can be formed from appropriate dye precursors in a processing step which is prior to the silver-dye-bleach step of the present processes. Illustrative precursors for the formation of yellow bleachable dyes, as well as methods for the formation of yellow dyes therefrom, can be found in U.S. Pat. Nos. 2,653,874 and 2,652,328. An advantage of using dye precursors in the present elements, rather than colored dyes, is the increased photographic speeds that generally result from such precursor use. It is preferred that dye precursor(s) be selected for use in the present invention which form yellow dye(s) during the black and white development step of the present processes.

The loss in photographic speed mentioned hereinbefore (the yellow dye-containing layer of the present photo elements) can also be at least partially overcome by multiple-coating the blue-sensitive emulsion and incorporating the bleachable yellow dye into the lower fraction of such a coating. This approach has been described heretofore, as in U.S. Pat. Nos. 3,650,739, for example.

If desired, incorporated yellow-dye-forming photographic color couplers can also be present in the yellow layer of the present photographic elements, care being taken to abide by the quantity limitations set out above. Examples of such incorporated (ballasted) yellow dye-forming color couplers can be found in the many publications in which incorporated couplers have been described. Such couplers are described in the references cited in Section XXII on page 11c of Product Licensing Index, December, 1971.

The green-sensitized and red-sensitized layers in the photographic elements of this invention contain incorporated magenta dye-forming and incorporated cyan dye-forming color couplers, respectively, in addition to the spectrally sensitized silver halide materials described above. Since the particular identity of the specific incorporated color-forming yellow, magenta and cyan couplers that are selected for use in the practice of this invention does not constitute an essential element of the invention, such materials will not be discussed in detail herein. Many examples of the use of incorporated color-forming photographic couplers exist, including, many of those described in Section XXII on page 110 of Product Licensing Index, December 1971.

Similarly, much has been published concerning the manufacture of multi-layer "color" photographic elements. See, for example, the several procedures referred to in Section XVIII on page 109 of Product Licensing Index, December 1971. The successful practice of the present invention does not depend upon any particular manipulative procedure being used in the manufacture of the photographic elements described above, nor in the use of any particular type of manufacturing equipment, so long as the essential features regarding constitution of the various color-forming layers, as set out hereinbefore, are observed.

The Process of the Invention

For convenience, the novel processes of the present invention will be set out once again in outline form. Such processes comprise the following steps:

a. Develop the imagewise exposed hybrid-BDIC element in non-color ("black and white") developer.
b. Rinse.
c. Contact the element with mild non-fixing silver-dye-bleach solution (this is the "non-fixing silver-dye-bleach" step.)
d. Rinse.
e. Fog and color develop.
f. Rinse.
g. Bleach and fix.

The rinse steps are preferred for best results, but are not essential. Otherwise, the steps set out must be performed, in the order set out above. Details concerning these process steps follow.

Step a — Black and White Development

During this step, an imagewise exposed hybrid BDIC element of the present invention is contacted with an aqueous solution of one or more developer materials capable of developing up a latent image in a silver halide emulsion, but which developer material(s) are incapable of reaction with the color-forming couplers in the element. Actually any black and white developer solution can be used in this step of the present process. For example, any of the non-color-forming developer solutions referred to in Section VI on page 107 and Section XXIII on page 110 of Product Licensing Index, December 1971, can be used in this step of the present processes.

Step c — Silver-Dye-Bleach Using Non-Fixing Solution

In the successful practice of the present invention, the use of a non-fixing silver-dye-bleach solution is essential, the necessity therefore being caused by the novel hybrid nature of our photographic elements, as described above. An example of such non-fixing silver-dye-bleach solutions is the following formulation:

| | | |
|---|---|---|
| Water | 1000 | ml |
| Phenazine | 0.2 | g |
| 12 N . HCl | 100 | ml |
| Potassium bromide | 100 | g/liter |

Any silver-dye-bleach solution which does not fix a substantial amount of silver halide in an unexposed segment of Kodak Verichrome Pan film in 5 minutes at 20° C. can be used successfully in this step of the present process.

Step 3 — Fog and Color Develop

Both fogging and color developing are included as a single step in this discussion of the present process because both can advantageously be performed during a single contacting operation in which the silver-dye-bleach-treated hybrid BDIC element is immersed in, or otherwise brought into contact with, an aqueous color developer solution containing, dissolved therein, a chemical foggant. Such solutions are well known in the art and need not be discussed in great detail here. Typical examples of useful color developer solutions and manipulative procedures for their use can be found in Section VI on page 107 and Section XXIII on page 110 of Product Licensing Index, December 1971.

Example of chemical foggant adjuvants for color developer solutions include dimethylamine borane, t-butylamine borane and tetramethyl ammonium hydra triborate. Alternatively, if desired, the element can be light struck (in order to exposed or "fog" any remaining unexposed silver halide particles) just prior to or during the early stage of the color developing step.

Step g — Bleach and Fix

Any bleaching and fixing procedure that is useful in the bleaching and fixing of conventional developed silver halide emulsions can be used successfully in the practice of this step. Examples of such bleaching and fixing are described in many publications including British Pat. Nos. 988,467; 1,032,024; 1,133,500; 1,150,466 and 991,412; U.S. Pat. Nos. 2,322,084; 2,748,000; 3,184,452; 3,352,676 and 3,372,030; and German Pat. Nos. 866,605; 947,221; 1,051,117 and 1,146,363.

Any practicing photographic chemist will appreciate the fact that optimum time and temperature sequences for each step in the present processes can readily be determined with only a small amount of experimentation. Generally, time and temperature sequences will vary, depending upon such factors as the particular components and addenda in the photographic elements being processed, the identity of the various components in the various baths, and also the concentration of the ingredients in the processing baths. A typical example of a useful time/temperature sequence is given in the Example which follows.

Although acceptable color images can be manufactured in accordance with the "element" and "process" aspects of the present invention independent from the particular levels of silver halide that are used in the various emulsion layers of the present invention (so long as there is at least enough silver halide to form an identifiable image after processing), one preferred embodiment of the invention involves the use of relatively higher (than usual) levels of silver halide in the red- and green-sensitized layers of our elements. Thus, preferred levels of silver halide in these layers is from about 15 to about 30 mg. silver halide per square decimeter of film in each of the green- and red-sensitized layers. In this preferred embodiment, the amount of silver halide in the yellow layer of our element is from about 6 to about 12 mg. silver halide per square decimeter of film. Using this embodiment results in optimum sensitivity (better image effects), when it is desired, and relatively higher color densities in the red-and green-sensitized layers. In those instances in which the use of higher levels of silver halide (to improve graininess, for example) in these layers also results in levels of magenta and cyan dye which are too high, the use of competing couplers in the color developer solutions (during the color development step in our process) is contemplated and advised. The use of competing couplers is well known in the art and need not be described in detail herein because ordinary usage of such materials is contemplated herein, and any desired competing coupler material can be used, as desired, with the usual precautions relating to color formation, relative reactivity, and concentration of the competing couplers being kept in mind. For example, it is preferred that a competing coupler be used that forms an essentially colorless reaction product with oxidized organic amino color developer materials. Competing couplers are described in detail in U.S. Pat. No. 3,647,452 and U.S. Pat. No. 2,689,793, and in many other publications.

It should be noted that the use of relatively higher levels of silver halide and competing couplers, as described immediately above, would be of little or no value in conventional color photography involving incorporated color-forming couplers because of the offsetting requirement in conventional photo-elements that a higher level of silver halide be used in the blue-sensitive layer. Otherwise, the effect of the use of competing coupler would be to unacceptably decrease the density of the yellow dye in the blue-sensitive layer. As was pointed out above, the use of such higher levels of silver halide in the yellow layer is undesirable for high quality photography because higher levels of silver halide in the outer layer(s) of the film element cause decreases in the image sharpness in the green- and red-sensitized layers (due to excessive scattering of the green and red light by the silver halide particles as that light passes through the outer, blue-sensitive layer). The avoidance of this problem represents one of the significant advances in the art that can result from practicing this invention.

EXAMPLE I

A. Preparation of Hybrid BDIC Element

By use of conventional multi-hopper coating techniques, a photosensitive film element was prepared having the following composition: (Coverage in each layer given is in mg. per square decimeter of film)

Support: Conventional cellulose acetate photographic film support.

layer 1: (attached directly to the support): Conventional grey silver antihalation layer;

Layer 2: Conventional gel sub layer, containing 12 mg. of gelatin

Layer 3: (Red-sensitized layer) Silver halide emulsion containing 16.8 mg. silver 5.7 mg. of 5-[α-(2,4-di-tert-amylphenoxy)hexanamido]-2-heptafluorobutyrlamidophenol, 5.7 mg. of 1-hydroxy-2-[Δ-(2,4-di-tert-amylphenoxy)-n-butyl]naphthamide and 32.2 mg. gelatin.

Layer 4: Conventional gel sub layer, containing 6.1 mg. gelatin

Layer 5: (Green-sensitized layer) Silver halide emulsion containing 13.4 mg. silver, as bromoiodide, 13.4 mg. of 1-(2,4,6-trichlorophenol)-3-[3-(2,4-di-tert-amylphenoxyacetamido)benzamido]-5-pyrazolone, and 23.8 mg. gelatin.

Layer 6: Conventional dye filter layer.

Layer 7: Conventional gel sub layer containing 3.5 mg. gelatin and 2.1 mg. of scavenger for oxidized color developer, 2,5-di-sec-dodecylhydroquinone.

Layer 8: (Blue-sensitive layer) Silver halide emulsion containing 9.7 mg. silver, as bromoiodide, 20.8 mg. gelatin, and 9.7 mg. of the shifted yellow azo (bleachable) dye described as Shifted Dye I, above.

Layer 9: Conventional gel protective overcoat containing 5.3 mg. gelatin.

B. Processing (Developing) the Hybrid BDIC Element

Using a conventional 38° C. sinkline process in which 12 cycle/minute nitrogen bursts performed the necessary solution agitation, the following sequence was practiced upon the film element described in part A of this Example:

| Time (Seconds) | Treatment |
|---|---|
| 150 | Black and White Develop[a] |
| 120 | Silver Dye Bleach (non-fixing[b]) |
| 120 | Wash With Water |
| 480 | Color Develop[c] |
| 120 | Acid Rinse[d] |
| 120 | Wash With Water |
| 120 | Bleach[e] |
| 5 | Rinse With Water |

-continued

| Time (Seconds) | Treatment |
|---|---|
| 120 | Fix(f) |
| 120 | Wash With Water |
| 60 | Stabilize(g) |
| 5 | Rinse With Water |
| — | Dry |

Identification of Solutions (a) 800 ml. water, 2.0 g. diaminopropanol tetraacetic acid, 8.0 g. sodium bisulfite, 44.0 g. sodium sulfite, 28.2 g. sodium carbonate, 20 g. hydroquinone, 0.35 g. 1-phenyl-3-pyrazolidone, 1.3 g. sodium bromide, 1.38 g. sodium thiocyanate, 13.0 mg. potassium iodide, 1.1 g. sodium hydroxide and water to make 1000 ml. This solution has a pH of 9.90 at 26.7° C.

(b) 1.0 liter water, 0.2 g. phenazine, 100 ml. 12 N hydrochloric acid and 100 g./l. potassium bromide.

(c) 800 ml. water, 5 g. diaminopropanol tetraacetic acid, 4.5 ml. benzyl alcohol, 7.5 g. sodium sulfite, 36 g. trisodium phosphate · $12H_2O$, 0.9 sodium bromide, 90 mg. potassium iodide, 3.2 g. sodium hydroxide, 18 g. citrazinic acid, 11 g. 4-amino-3-methyl-N-ethyl-β-(methanesulfonamido)ethylaniline sesquisulfate hydrate, 3 g. ethylenediamine, 0.02 g. of t-butylamine borane, and water to make 1000 ml. This solution has a pH of 11.65 at 26.7° C.

(d) 800 ml. water, 30 ml. glacial acetic acid, 1.75 g. sodium hydroxide, all diluted with water to make 1 liter of solution.

| | | | |
|---|---|---|---|
| (e) | Bleach | | |
| | Water | 800.0 | ml |
| | NaBr | 35.0 | g |
| | Sodium Ferrocyanide decahydrate | 240.0 | g |
| | Potassium persulfate | 67.0 | g |
| | Borax . $5H_2O$ | 1.0 | g |
| | NaOH | 0.1 | g |
| | Water to | 1 | liter |
| | pH at 80° F. = 8.2 ± .15 | | |
| | Sp Gr at 80° F. = 1.166 ± .015 | | |
| (f) | Fix | | |
| | Water | 800.0 | ml |
| | Sodium thiosulfate $5H_2O$ | 250.0 | g |
| | Sodium sulfite | 54.0 | g |
| | Water to | 1 | liter |
| | pH at 80° F. = 8.10 | | |

(g) 20 g. sodium carbonate and 5 g. hexadecyltrimethylammonium bromide dissolved in 1000 ml. water.

The resulting "positive" color film element (transparency) has excellent graininess and sharpness.

The stabilizer step (following the "fix" step) in the above process was used in order to permanently "shift" the absorption peak of the yellow dye into the desired visible region. It has been found that a desirable degree of stabilization can be accomplished by simply washing the fixed element with an aqueous solution having a pH above about 10. However, better color stabilization can result if the stabilizing solution also contains at least one cationic material such as a cationic surfactant. Examples of preferred cationic, water soluble stabilizers are hexadecyltrimethylammonium bromide and others such as are described in U.S. application Ser. No. 169,706, filed Aug. 6, 1971 and entitled "Onium Indophenoxides".

EXAMPLE II

Using conventional multi-hopper coating techniques, a photosensitive hybrid-BDIC film element was prepared having the following structure: (Coverage in each layer given is in mg. per square decimeter.)

HYBRID BDIC ELEMENT

Support: Conventional poly(ethyleneterephthalate) photographic film support.

Layer 1: Conventional grey silver antihalation layer

Layer 2: Gel sub containing 11.3 mg. gelatin.

Layer 3: Red sensitized silver bromiodide (16.8 mg. Ag), 32.2 mg. gelatin and 9.1 mg. 2-(α-di-tert-amylphenoxy butyrylamino)-4,6-dichloro-5-methyl phenol.

Layer 4: Gel interlayer containing 5.7 mg. gelatin

Layer 5: Green sensitized silver bromoiodide (28.2 mg. Ag), 23.8 mg. gelatin and 15.4 mg. 1-(2,4,6-Trichlorophenyl)-3-[3-(2,4,-di-tert-amylphenoxyacetamido)benzamido]-5-pyrazolone.

Layer 6: Conventional yellow dye filter layer.

Layer 7: 5.0 mg. gelatin and 2.0 mg. 2,5-di-sec.-dodecylhydroquinone.

Layer 8: Blue sensitive silver bromoiodide (6.3 mg. Ag), 20.8 mg. gelatin and 5.6 mg. of the bleachable yellow dye,

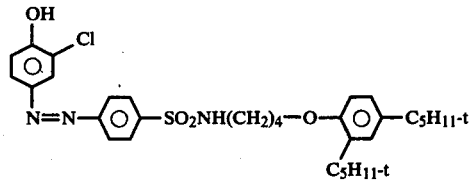

Layer 9: Gel protective overcoat containing 5.0 mg. gelatin.

This element was dried conventionally, imagewise exposed, and then processed by the procedure set out in Example I, above.

For purposes of comparison, a "control" element was prepared via the same manipulative techniques, having the following structure:

CONTROL ELEMENT

Support: Conventional poly(ethyleneterephthalate) photographic film support.

Layer 1: Conventional grey silver antihalation layer.

Layer 2: Gel sub containing 11.3 mg. gelatin.

Layer 3: Red sensitized silver bromoiodide (14.0 mg. Ag), 25.4 mg. gelatin, 4.5 mg. 5-[α-(2,4-di-tert-amylphenoxy)-hexanamido]-2-heptafluorobutyrlamidophenol and 4.5 mg. 1-hydroxy 2-[4-(2,4-di-tert-amylphenoxy)-n-butyl]naphthamide.

Layer 4: Gel interlayer containing 5.7 mg. gelatin.

Layer 5: Green sensitized silver bromoiodide (14.1 mg. Ag), 23.8 mg. gelatin and 15.4 mg. 1-(2,4,6-trichlorophenyl)-3-[3-(2,4-di-tert-amylphenoxyacetamido)benzamido]-5-pyrazolone.

Layer 6: Yellow dye filter layer.

Layer 7: 5.0 mg. gelatin and 2.0 mg. 2,5-di-sec.-dodecylhydroquinone

Layer 8: Blue sensitive silver bromoiodide (11.8 mg. Ag), 27.0 mg. gelatin and 20.2 mg. α-pivalyl-α-(4-carboxyphenoxy)-2-chloro-5-[α-(2,4-di-tert-amylphenoxy)-butyrlamido]-acetanilide.

Layer 9: Protective gel overcoat containing 5 mg. gelatin.

This control element was then imagewise exposed and processed conventionally by a commercially used procedure. A very low level of citrazinic acid was present during the developing step of this conventional process. Note that approximately 20% more silver was present in the red sensitive layer of the hybrid BDIC element than in the corresponding layer in the control, and twice as much silver was in the green sensitive layer of the hybrid BDIC element than in the corresponding layer of the control element. Also, because of the generally improved efficiency of the silver dye bleach reaction, somewhat less silver is needed in the blue sensitive layer of the hybrid BDIC element. This also should contribute to improved sharpness characteristics in some of the preferred hybrid BDIC elements of this invention.

Then the processed control element and the hybrid BDIC element of this example were compared for (1) neutral scale characteristics, (2) granularity and sharpness. Results of this comparison were as follows:

(1) neutral scale characteristics — somewhat lower Dmax levels were produced in all three layers of the hybrid BDIC element, although the color balance was very good. Dmax in the cyan and magenta layers can be increased, if desired, by using less citrazinic acid competing coupler. Increased Dmax in the yellow layer can be obtained by simply using more yellow dye.

(2) granularity* — The granularity of the magenta layer of the BDIC element was substantially better than that of the control, while the granularity of the cyan layer of the BDIC element was equal to that of the control, and the granularity of the yellow layer was somewhat poorer than that of the control.

* RMS granularity test — Mees, "The Theory of the Photographic Process", P. 525, MacMillan Co. (1966).

(3) Sharpness** — significantly improved sharpness was obtained in the BDIC element's magenta and cyan layers.

** MTF sharpness — Pamphlet No. P-49 "Modulation Transfer Data for Kodak Films", Eastman Kodak Co. Rochester, N.Y.

The invention has been described in detail with particular reference to preferred embodiments thereof, but, it will be understood that variations and modifications can be effected within the spirit and scope of the invention.

What is claimed is:

1. In a photosensitive multilayer color photographic element which comprises at least two photosensitive silver halide containing emulsion coatings on a photographic support; said coatings being further defined as:

(a) a first coated portion of said element which contains a first layer which is spectrally sensitive to the blue visible region of the spectrum and contains, incorporated therein, at least one yellow dye-forming coupler material capable of forming a non-bleachable yellow dye upon reaction of said coupler material with oxidized organic amino color developer; and (b) a second coated portion of said element which contains a second layer which is spectrally sensitized to the green visible region of the spectrum and contains, incorporated therein, at least one color-forming coupler material capable of forming a magenta dye upon reaction of said coupler material with oxidized organic amino color developer, and said second coated portion being closer to said photographic support than said first coated portion;

the improvement wherein said first coated portion of said element contains a shifted silver-dye-bleachable yellow dye in an amount sufficient to provide greater than half of the yellow dye density formed in the element; said shifted silver-dye-bleachable yellow dye being capable of being destroyed as a function of the metallic silver content of said first layer when said element is contacted with a silver-dye-bleach solution, and having an absorption maximum in the ultraviolet region of the spectrum at an emulsion pH of about 6 and an absorption maximum in the blue region of the spectrum at a pH of 10.

2. An improved color photographic element as in claim 1, wherein said first coated portion of said element is divided into at least two contiguous layers, one of said contiguous layers containing substantially all of said shifted silver-dye-bleachable yellow dye and underlying the other of said contiguous layers which contains silver halide and substantially no silver-dye-bleachable yellow dye.

3. An improved color photographic element as in claim 2, wherein said shifted silver-dye-bleachable yellow dye has at least one azo group in its molecule.

4. An improved color photographic element as in claim 2, wherein said first coated portion of said element is divided into at least two contiguous layers, one of said contiguous layers containing substantially all of said shifted silver-dye-bleachable yellow dye and underlying the other of said contiguous layers which contains silver halide and substantially no silver-dye-bleachable yellow dye.

5. An improved color photographic element as in claim 4, wherein said shifted silver-dye-bleachable yellow dye has at least one azo group in its molecule.

6. In a photosensitive multilayer color photographic element which comprises at least three photosensitive silver halide-containing emulsion coatings on a photographic support; said coating being further defined as:

(a) a first coated portion of said element which contains a first layer which is spectrally sensitive to the blue visible region of the spectrum and contains, incorporated therein, at least one yellow dye-forming coupler material capable of forming a non-bleachable yellow dye upon reaction of said coupler material with oxidized organic amino color developer;

(b) a second coated portion of said element which contains a second layer which is spectrally sensitized to the green visible region of the spectrum and contains, incorporated therein, at least one color-forming coupler material capable of forming a magenta dye upon reaction of said coupler material with oxidized organic amino color developer; and (c) a third coated portion of said element which contains a third layer which is spectrally sensitized to the red region of the visible spectrum and contains, incorporated therein, at least one color-forming coupler material capable of forming a cyan dye upon reaction of said coupler material with oxidized organic amino color developer, said third coated portion being closer to said support than said first coated portion;

the improvement wherein said first coated portion of said element contains a shifted silver-dye-bleachable yellow dye in an amount sufficient to provide greater than half of the yellow dye density formed in the element; said shifted silver-dye-bleachable yellow dye being capable of being destroyed as a function of the metallic silver content of said first layer when said element is contacted with a silver-dye-bleach solution, and having an absorption maximum in the ultraviolet region of the spectrum at an emulsion pH of about 6 and an absorption maximum in the blue region of the spectrum at a pH of 10.

7. An improved color photographic element as in claim 6 wherein said shifted yellow dye has at least one azo group in its molecule.

8. An improved color photographic element as in claim 7, wherein said shifted yellow dye has the structure:

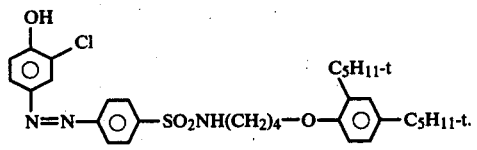

9. An improved color photographic element as in claim 7, wherein said shifted yellow dye has the structure:

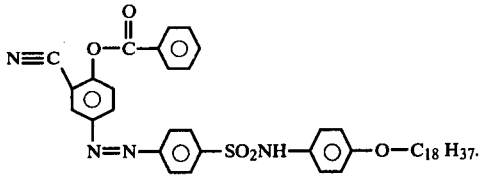

10. A photosensitive multilayer color photographic element which comprises at least three differentially photosensitive silver halide-containing emulsion coatings upon a photographic support; said coatings being defined as:

(a) a first coated portion containing (i) silver halide which is spectrally sensitive to the blue region of the visible spectrum and (ii) at least one shifted silver-dye-bleachable yellow dye capable of being destroyed as a function of the metallic silver content of said first coated portion when said element is contacted with a silver-dye-bleach solution;

(b) a second coated portion containing (i) silver halide which is spectrally sensitized to the green region of the visible spectrum and (ii) at least one color-forming coupler material capable of forming a magenta dye upon reaction with oxidized organic amino color developer; and (c) a third coated portion containing (i) silver halide spectrally sensitized to the red region of the visible spectrum and (ii) at least one color-forming coupler material capable of forming a cyan dye upon reaction with oxidized organic amino color developer said second and third coated portions being positioned closer to said support than said first coated portion.

11. An improved color photographic element as in claim 10, wherein said shifted silver-dye-bleachable yellow has at least one azo group in its molecule.

12. An improved color photographic element as in claim 10, wherein the amount of silver halide in said second coated portion of said element is at least about 1.5 times, by weight, the amount of silver halide in said first coated portion.

* * * * *

UNITED STATES PATENT AND TRADEMARK OFFICE

CERTIFICATE OF CORRECTION

PATENT NO. : 4,153,459

DATED : May 8, 1979

INVENTOR(S) : Dan Neuberger and Jon T Staples

It is certified that error appears in the above-identified patent and that said Letters Patent are hereby corrected as shown below:

Title page, second column, item [57] ABSTRACT, line 9, after "a", --novel-- should be inserted. Column 14, line 28, "2" should read --6--; line 41, "coating" should read --coatings--. Column 16, line 37, after "yellow", --dye-- should be inserted.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*